US012479542B2

(12) United States Patent
Webber et al.

(10) Patent No.: US 12,479,542 B2
(45) Date of Patent: Nov. 25, 2025

(54) WATER SKI RAMPS

(71) Applicants: James Webber, Dow, IL (US); Jeff Roberts, Dow, IL (US)

(72) Inventors: James Webber, Dow, IL (US); Jeff Roberts, Dow, IL (US)

( * ) Notice: Subject to any disclaimer, the term of this patent is extended or adjusted under 35 U.S.C. 154(b) by 549 days.

(21) Appl. No.: 17/959,525

(22) Filed: Oct. 4, 2022

(65) Prior Publication Data

US 2023/0105124 A1 Apr. 6, 2023

Related U.S. Application Data

(60) Provisional application No. 63/251,906, filed on Oct. 4, 2021.

(51) Int. Cl.
*B63B 35/00* (2020.01)

(52) U.S. Cl.
CPC ..... *B63B 35/00* (2013.01)

(58) Field of Classification Search
CPC ..... B63B 35/00; B63B 35/34; B63B 32/30
USPC ..... 114/263, 264
See application file for complete search history.

(56) References Cited

U.S. PATENT DOCUMENTS 4,662,781 A * 5/1987 Tinkler ..... A63C 19/10 405/52
4,833,750 A * 5/1989 Gherling ..... E01D 15/22 14/27
7,552,495 B1 * 6/2009 Rogerson ..... B63B 35/40 114/263

* cited by examiner

*Primary Examiner* — Daniel V Venne
(74) *Attorney, Agent, or Firm* — BURR & FORMAN

(57) ABSTRACT

A water ski ramp that can be selectively adjusted to provide a variety of launch heights for a jumper is provided. The water ski ramp includes a floating dock comprising a first dock portion and a second dock portion operatively connected to the first dock portion, in which the first dock portion and the second dock portion define an obtuse angle 'α' therebetween. The water ski ramp also includes a jumping platform operatively connected to the second dock portion via a dock-to-surface hinge. The water ski ramp may also include an adjustable lift including a first end operatively connected to the first dock portion and a second end operatively connected to the jumping platform, in which the adjustable lift and the first dock portion define an acute angle 'β' therebetween.

20 Claims, 13 Drawing Sheets

WATER SKI RAMPS

CROSS-REFERENCE TO RELATED APPLICATIONS

This application claims priority under 35 U.S.C. § 119(e) to U.S. Provisional Application No. 63/251,906, filed Oct. 4, 2021, which is expressly incorporated by reference herein in its entirety.

TECHNICAL FIELD

Embodiments of the presently-disclosed invention relate generally to water ski ramps that may be selectively adjusted to provide a variety of different surface-to-water (STW) elevations and methods of teaching an individual how to perform a jump over a water ski ramp.

BACKGROUND

Water ski ramps have been in existence for over ninety (90) years. They are generally massive in size which makes them intimidating to a novice ski jumper. Existing miniature or novice water ski ramps attempt to minimize the intimidation (and thus increase participation) by reducing the size and by providing a lower surface-to-water (STW) elevation at the launching point of the water ski jump. These design iterations, however, are woefully inadequate in both design and construction and consequently have short lives. Additionally, these water ski ramps do not have a mechanism and/or means to adjust the STW elevation. Still yet, these water ski ramps have rudimentary anchoring adjustment systems and they also lack back-wash protection features, resulting in boat wakes bouncing back into the skiers paths.

In this regard, there remains a need in the art for water ski ramps that provide one or more of the following features: selective adjustability of the STW elevation, improved anchoring adjustment systems, and back-wash protection.

SUMMARY OF THE DISCLOSURE

Certain embodiments according to the invention provide a water ski ramp including a floating dock comprising a first dock portion and a second dock portion operatively connected to the first dock portion, in which the first dock portion, and the second dock portion define an obtuse angle '$\alpha$' therebetween. The water ski ramp may also include a jumping platform operatively connected to the second dock portion via a dock-to-surface hinge. In accordance with certain embodiments of the invention, the water ski ramp may also include an adjustable lift including a first end operatively connected to the first dock portion and a second end operatively connected to the jumping platform, in which the adjustable lift and the first dock portion define an acute angle '$\beta$' therebetween.

In another aspect, the present invention provides a method of teaching an individual how to perform a jump over a water ski ramp. The method may include providing a water ski ramp as disclosed herein, and adjusting the water ski ramp to a first STW elevation. The method may also include pulling the individual across and over the water ski ramp for a predetermined number of successful jumps, wherein a successful jump may comprise the combination of the individual entering the water ski ramp at a back end of the water ski ramp, traversing a length of a jumping platform of the water ski ramp, launching off a front end of the water ski ramp, landing on a water surface, and skiing away from the water ski ramp. The method may further comprise adjusting the water ski ramp to a second STW elevation, which is larger than the first STW elevation, after the user has completed the predetermined number of successful jumps at the first STW elevation.

BRIEF DESCRIPTION OF THE DRAWING(S)

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein.

DETAILED DESCRIPTION

Figure 1A:
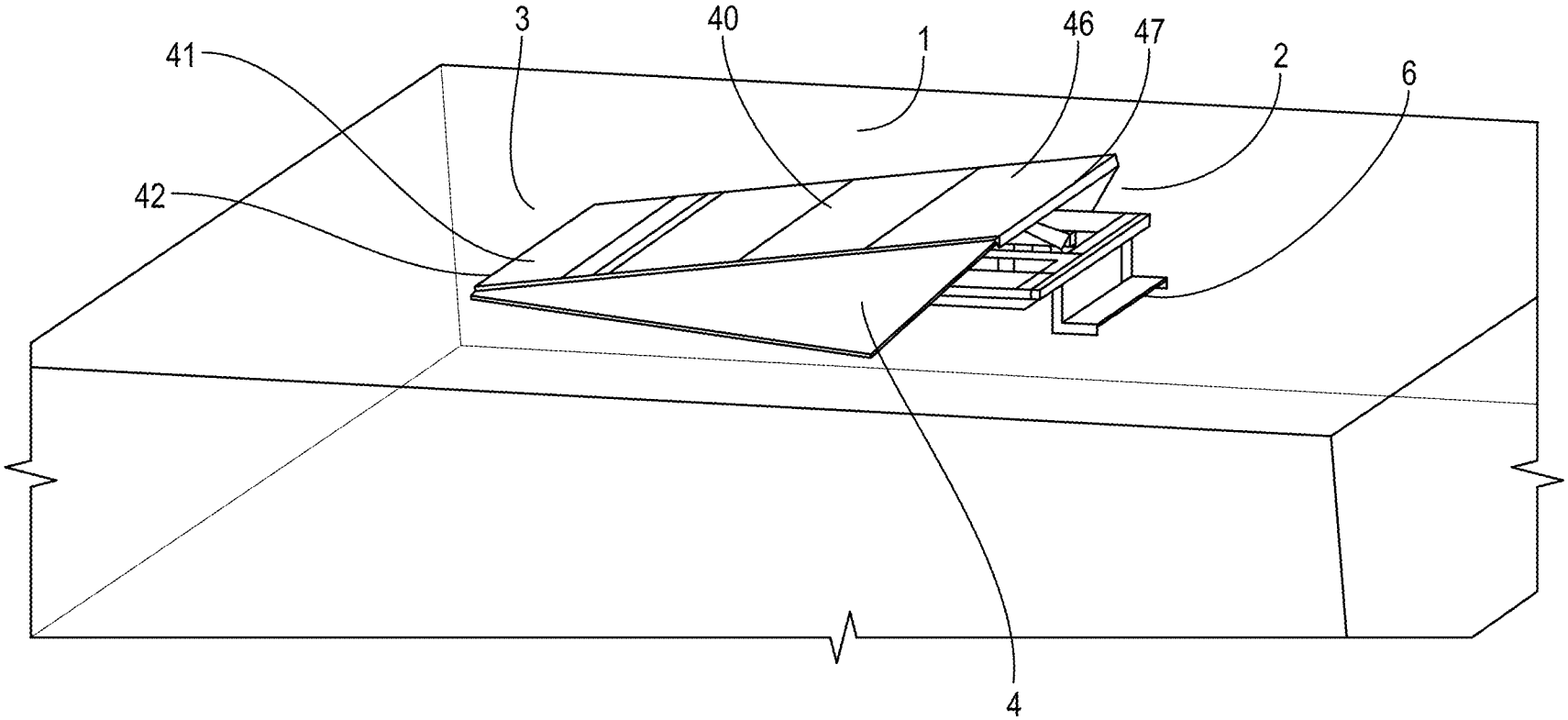
FIG. 1A illustrates a rendering of a water ski ramp in accordance with certain embodiments of the invention.

Embodiments of the invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Embodiments of the present invention relate generally to a water ski ramp that may comprise two hinged structures allowing a water skier to traverse from water to ramp surface to air to water. The first structure, for instance, comprises a floating dock and the second structure (e.g. a jump platform including a jumping surface) provides a flat, low friction surface for the skis to cross. The water ski ramp, in accordance with certain embodiments of the invention, may comprises a jumping surface that is smaller than those associated with more traditional water ski ramps. For example, the jumping surface may comprise a surface area exposed to a water skier from at least about any of the following: 80, 90, 100, 110, 120, 130 square feet, and/or at most about any of the following: 210, 200, 190, 180, 170, 160, 150, and 140 square feet. By way of example only, the jumping surface may have a surface area exposed to a water skier of about 128 square feet, which is slightly more than ⅓ the size of jumps currently used in sanctioned water ski tournaments. In this regard, the water ski ramp in accordance with certain embodiments of the invention may present to a novice skier a less-intimidating visual of size, height, and angle. With significantly less ramp surface to water ("STW") elevation (e.g., 18" vs. 60"), in which the STW is the height above water at a launch point from the water ski ramp, and far less daunting angle (e.g., 0.1111 compared to 0.235 height to length (above water) ratio of the jumping surface), the low setting or settings may provide an encouraging starting point for beginner jumpers to learn the basics of water ski jumping.

In accordance with certain embodiments of the invention, the water ski ramp may be easily adjustable with the use of a easily-accessible mounted adjustable lift (e.g., a hydraulic hand pump connected with a hydraulic hose to a cylinder/ram that pivots at one end on a dock frame and the other end on the jumping platform). This adjustable feature, in accordance with certain embodiments of the invention, provides a range from a lowest setting of 10" STW to 60" STW. In accordance with certain embodiments of the invention, the water ski ramp may provide a range of STW values from at least about any of the following: 10, 12, 18, 24, 30, 36, and 40 inches, and/or at most about any of the following: 60, 54, 48, 42, and 40 inches. By way of example only, a water ski ramp may provide a range from a lowest setting of 18" STW to 40" STW. As a novice water ski jumpers advance, the STW value of the water ski ramp may be increased. In accordance with certain embodiments of the invention, the positioning and design of the dock-to-surface hinge, the above water length of the jumping surface varies only minimally as the height settings (e.g., STW values) are adjusted.

In one aspect, the present invention provides a water ski ramp including a floating dock comprising a first dock portion and a second dock portion operatively connected to the first dock portion, in which the first dock portion and the second dock portion define an obtuse angle 'α' therebetween. In accordance with certain embodiments of the invention, the angle 'α' may have a value from about 178 to about 160 degrees, such as at most about any of the following: 178, 177, 176, 175, 174, 173, 172, 171, and 170 degrees, and/or at least about any of the following: 160, 161, 162, 163, 164, 165, 166, 167, 168, 169, and 170 degrees. The water ski ramp may also include a jumping platform operatively connected to the second dock portion via a dock-to-surface hinge. In accordance with certain embodiments of the invention, the water ski ramp may also include an adjustable lift including a first end operatively connected to the first dock portion and a second end operatively connected to the jumping platform, in which the adjustable lift and the first dock portion define an acute angle 'β' therebetween. In accordance with certain embodiments of the invention and as discussed in more detail below, the angle 'β' may be varied by operation of the adjustable lift to raise and/or lower the jumping platform relative to the first dock portion 20. For example, the angle 'β' may be at least about any of the following: 4, 5, 6, 6.6, 7, 8, 9, 10, 11, and 12 degrees, and/or at most about any of the following: 20, 19, 18, 17, 16, 15, 14.7, 14, 13, and 12 degrees.

In accordance with certain embodiments of the invention, the first dock portion may comprise a first back end and a first front end, and the second dock portion may comprise a second back end and a second front end. The first back end, in accordance with certain embodiments of the invention, may be being operatively connected to the second front end, such as by welding or via one or more fasteners. In accordance with certain embodiments of the invention, the first dock portion may comprise an outer frame substantially lying in an x-y plane. The x-y plane, for example, may be generally parallel to an air-water interface when the water ski ramp is floating on a body of water.

In accordance with certain embodiments of the invention, the second dock portion may extend outwardly from the first back end and out of the x-y plane to define an angle 'γ' between the x-y plane and the second dock portion. In accordance with certain embodiments of the invention, the angle 'α' and the angle 'γ' are supplementary angles. In this regard, the angle 'γ' may comprise any value such that the sum of angle 'α' and the angle 'γ' is 180 degrees. In accordance with certain embodiments of the invention, the angle 'γ' may have a value from about 2 to about 20 degrees, such as at least about any of the following: 2, 3, 4, 5, 6, 7, 8, 9, and 10 degrees, and/or at most about any of the following: 20, 19, 18, 17, 16, 15, 14, 13, 12, 11, and 10 degrees.

In accordance with certain embodiments of the invention, the dock-to-surface hinge may comprise a pivot pin located at or proximate to the second back end, in which the pivot pin is configured to engage a corresponding female member of the jumping platform. For example, the second back end may include a pair of pivot pins located on opposite sides of the second back end, while the jumping platform may include a pair of corresponding female members configured to couple with the pivot pins in a manner such that the jumping platform is movable relative to the floating dock. In accordance with certain embodiments of the invention, the jumping platform is rotatable about an axis defined by the pivot pin(s).

The jumping platform, in accordance with certain embodiments of the invention, may comprise a low portion located proximately to the second back end, and a high portion located proximately to the first front end, in which the low portion terminates at a first location below the x-y plane noted above and the high portion terminates at a second location above the x-y plane as noted above. When the water ski ramp is floating on a body of water, for example, the first location may be located underneath the surface (e.g. water-air interface) of the body of water and the second location may be located above the surface (e.g. water-air interface) of the body of water.

As noted above, the water ski ramp may comprise an adjustable lift including a first end operatively connected to the first dock portion and a second end operatively connected to the jumping platform, in which the adjustable lift and the first dock portion define an acute angle 'β' therebetween. The first end of the adjustable lift, for example, may be operatively connected to the high portion of the jumping platform or a central body portion of the jumping platform.

For instance the jumping platform nay have a jumping length defined by the shortest distance between the first location and second location of the jumping platform (e.g., the termination location noted above), and the central body portion may comprise a plurality of discrete locations within the middle 80% of the jumping length, such as within the middle 70%, the middle 60%, the middle 50%, or the middle 40% of the jumping length. Additionally or alternatively, the high portion may comprise from about 30% of the jumping length measured from the second location (e.g., point of launch for a jumper traversing the water ski ramp), such as from about 25%, 20%, 15%, 10%, or 5% of the jumping length measured from the second location.

The first end of the adjustable lift, for example, may be operatively connected to the jumping platform via a first pivoting connection, the second end of the adjustable lift may be operatively connected to the first dock portion via a second pivoting connection, or both. The first and/or second pivoting connections in conjunction with the dock-to-surface hinge facilitate movement of the jumping platform relative to the floating dock in a manner to adjust the STW value at the second location (e.g., point of launch for a jumper traversing the water ski ramp). In accordance with certain embodiments of the invention, the adjustable lift may comprise a hydraulic lift comprising a moveable cylinder to effectuate movement of the jumping platform relative to the floating dock.

). In accordance with certain embodiments of the invention, the second location (e.g., point of launch for a jumper traversing the water ski ramp) above the x-y plane of the jumping platform may comprise from about 10 inches to about 60 inches above a water-air interface when the water ski ramp is located in a body of water, such as at least about any of the following: 10, 12, 18, 24, 30, 36, and 40 inches above a water-air interface when the water ski ramp is located in a body of water, and/or at most about any of the following: 60, 54, 48, 42, and 40 inches above a water-air interface when the water ski ramp is located in a body of water.

In accordance with certain embodiments of the invention, the water ski ramp may further comprise at least one support column releasably connecting the first dock portion, and the high portion and/or central body portion of the jumping platform. By way of example only, the at least one support column may comprise a plurality of support columns, including a first support column and a second support column. In accordance with certain embodiments of the invention, at least the first support column includes a first support end releasably connected to the high portion and/or central body portion of the jumping platform via a first insertable and removable pin. For example, at least the first support column includes a plurality of corresponding pairs of through-holes along a length of the first support column. The plurality of corresponding pairs of through-holes, for example, may be configured to receive a second insertable and removable pin. Additionally or alternatively, the first front end of the first dock portion may comprise at least one retaining bracket including a pair of corresponding bracket-through-holes, in which the at least one support member (e.g., the first support column) passes through a first retaining bracket and the second insertable and removable pin passes through the pair of corresponding bracket-through-holes and a first corresponding pairs of through-holes of the first support member to lock the first support member and the jumping platform into place. In accordance with certain embodiments, the water ski ramp may include two essentially identical support columns and connection means, and locking means.

In accordance with certain embodiments of the invention, the jumping platform may comprise a jump frame and a jumping surface, in which the jumping surface may be directly or indirectly supported by and/or connected to the jumping frame. In this regard, the jumping surface comprises a generally planar surface that will be contacted by the water skis of a juniper when traversing the water ski ramp. The jump frame may comprise a plurality of outer frame elements defining a perimeter of the jump frame. For instance, the plurality of outer frame elements may include at least a first pair of corresponding outer frame elements defining a back end of the jump frame and the front end of the jump frame, and a second pair of corresponding outer frame elements connected to and extending between the first pair of corresponding outer frame elements. In accordance with certain embodiments of the invention, the jump frame may comprise one or more cross-support members connected to and extending between the first pair of corresponding outer fame elements, the second pair of corresponding outer frame elements, or both.

As noted above, the jumping surface may comprise a planar surface extending from the back end of the jump frame to the front end of the jump frame or beyond. The jumping surface may comprise fiberglass. In accordance with certain embodiments of the invention, the jumping surface may comprise pebbled fiberglass bonded to a plywood underlayment.

In accordance with certain embodiments of the invention, the jumping surface has a back end that is submerged under a water-air interface when the water ski jump is placed in water and a front end located above the water-air interface when the water ski jump is placed in water, in which a first distance from the front end of the jumping surface to the water-air interface defines a launch height, and a second distance from the back end to the front end of the jumping surface defines a ramp length. In accordance with certain embodiments of the invention, the water ski jump has a launch height (inches) to ramp length (inches) ratio from about 0.05 to about 0.28, such as at least about any of the following: 0.05, 0.07, 0.09, 0.1, 0.115, 0.2, 0.14, 0.15, 0.16, and 0.18, and/or at most about any of the following: 0.28, 0.27, 0.263, 0.26, 0.25, 0.22, 0.20, and 0.18.

In accordance with certain embodiments of the invention, the water ski ramp may also include a kneeling platform, operatively connected to the first front end of the first dock portion. The kneeling platform, for example, may comprise a base portion that is substantially parallel to the first dock portion and extends outwardly relative to the first front end of the first dock portion. The kneeling platform, for example, may be directly or indirectly connected to the first dock portion vie one or more connection members. Additionally or alternatively, the kneeling platform may substantially lie in a second x-y plane. In accordance with certain embodiments of the invention, the kneeling platform may be located underneath the water surface when the water ski ramp is floating in a body of water. Additionally or alternatively, the kneeling platform may also comprise one or more bumpers that extend upwardly from the kneeling platform and out of the second x-y plane.

In accordance with certain embodiments of the invention, the water ski ramp may also comprise an extendable bumper apparatus operatively connected to the first dock portion and/or the kneeling platform. The extendable bumper apparatus may comprise a first arm pivotally connected to the first dock portion or the kneeling platform via a first selectively adjustable hinge connection, a first upwardly extending member connected to the first arm, a second arm connected to the first upwardly extending member, and a first upwardly extending bumper connected to the second arm. In accordance with certain embodiments of the invention, the first upwardly extending member, the first upwardly extending bumper, or both may extend generally perpendicular to the first dock portion.

In accordance with certain embodiments of the invention, the water ski ramp may comprise a plurality of conduits directly or indirectly connected to the first dock portion. The plurality of conduits, for example, may include a first conduit including a first conduit inlet located above the first dock portion and at or proximate to the first front end of the first dock portion and a first conduit outlet located below the first dock portion and proximate the first dock portion. Additionally or alternatively, the plurality of conduits may include a second conduit including a second conduit inlet located above the first dock portion and at or proximate to the first front end of the first dock portion and a second conduit outlet located below the first dock portion and proximate the first dock portion, in which the first conduit is located at or proximate to a first side portion of the water ski ramp and the second conduit is located at or proximate to a second side portion of the water ski ramp. Additionally or alternatively, the plurality of conduits includes a third conduit including a third conduit inlet located above the first dock portion or proximate the x-y plane of the first dock portion and a third conduit outlet located below the second dock portion and proximate the second dock portion. Additionally or alternatively, the plurality of conduits includes a fourth conduit including a fourth conduit inlet located above the first dock portion or proximate the x-y plane of the first dock portion and a fourth conduit outlet located below the second dock portion and proximate the second dock portion, in which the third conduit is located at or proximate to a first side portion of the water ski ramp and the fourth conduit is located at or proximate to a second side portion of the water ski ramp. In accordance with certain embodiments of the invention, the water ski ramp may comprise a plurality of anchor lines attached to the water ski ramp on respective first ends and extending through the respective conduits, in which the respective anchor lines may each include an anchor on respective second ends of the anchor lines. For example, the water ski jump may comprise a first anchor line that extends completely through the first conduit to provide a first anchoring location for the water ski ramp. The water ski ramp may comprise a second anchor line that extends completely through the second conduit to provide a second anchoring location for the water ski ramp. The water ski ramp may comprise a third anchor line that extends completely through the third conduit to provide a third anchoring location for the water ski ramp. The water ski ramp may comprise a fourth anchor line that extends completely through the second conduit to provide a fourth anchoring location for the water ski ramp.

Figure 1B:
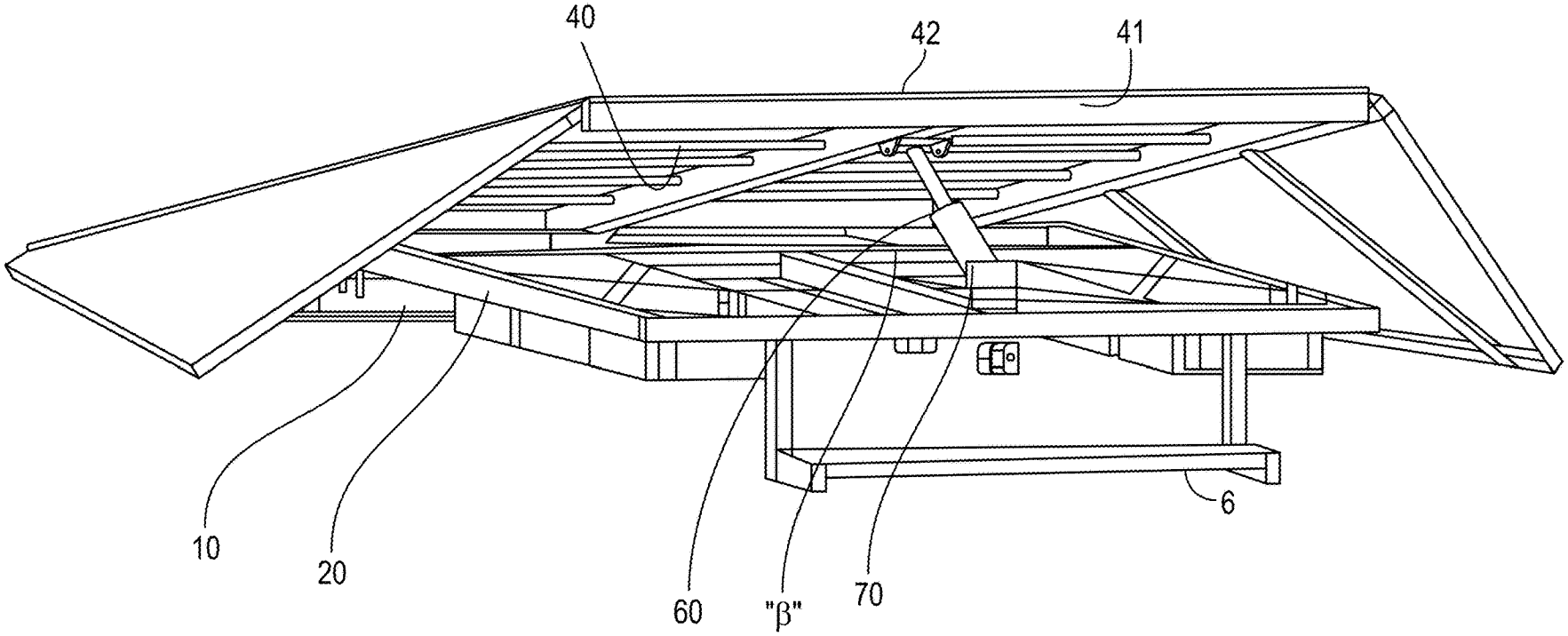
FIG. 1B is illustrates a rendering of the front end of the water ski ramp of FIG. 1A.

FIG. 1A, for instance, illustrates a rendering of a water ski ramp 1 in accordance with certain embodiments of the invention. FIG. 1A illustrates a water ski ramp 1 floating in a body of water. The water ski ramp shown in FIG. 1A includes a front end 2 where a jumper launches off the water ski ramp, a back end 3 wherein a jumper enters the water ski ramp, and side curtains 4. The example embodiment shown in FIG. 1A also includes a kneeling platform 6. FIG. 1B illustrates a rendering of the front end of the water ski ramp 1 of FIG. 1A. FIG. 1B shows the floating dock 10 including the first dock portion 20. FIG. 1B also illustrates the underside of the jumping platform 40, which includes a jump frame 41 that supports a jumping surface 42. Additionally, FIG. 1B illustrates the adjustable lift 60 including a first end 70 operatively connected to the jumping platform 40, and a second end 80 operatively connected to the first dock portion 20. The adjustable lift 60 and the first dock portion 20 define an acute angle 'β' therebetween. In accordance with certain embodiments of the invention and as discussed in more detail below, the angle 'β' may be varied by operation of the adjustable lift to raise and/or lower the jumping platform relative to the first dock portion 20. For example, the angle 40' may be at least about any of the following: 4, 5, 6, 6.6, 7, 8, 9, 10, 11, and 12 degrees, and/or at most about any of the following: 20, 19, 18, 17, 16, 15, 14.7, 14, 13, and 12 degrees.

Figure 2A:
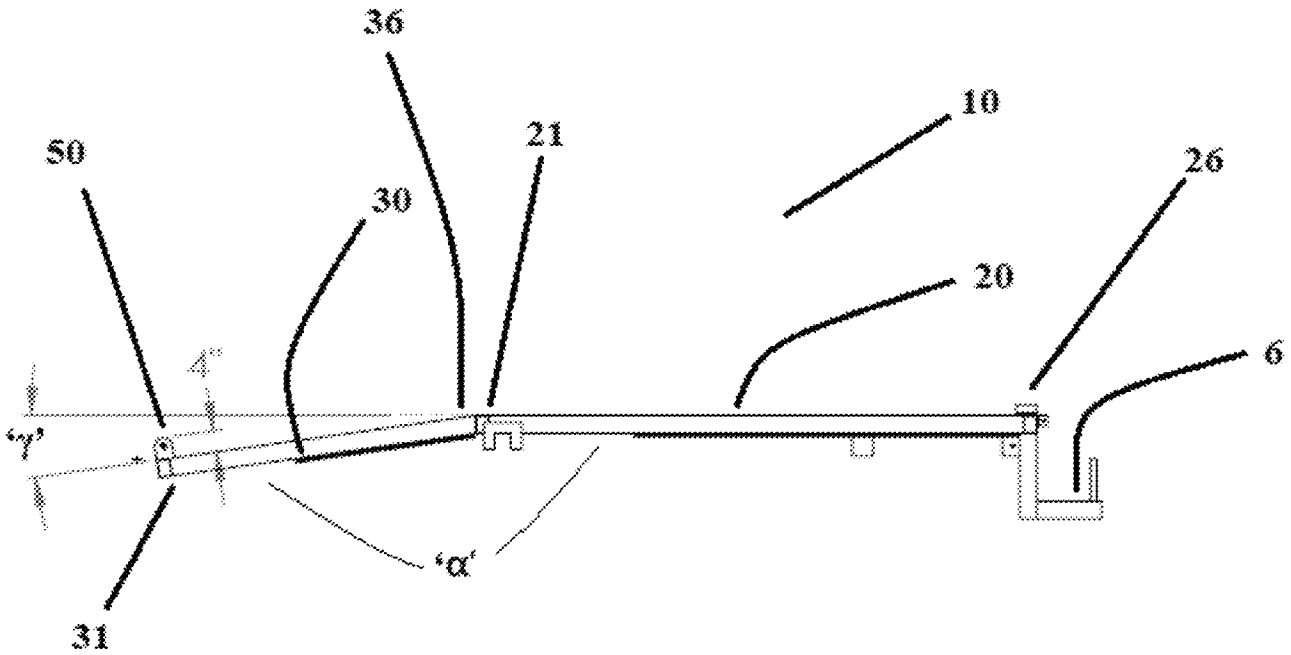
FIG. 2A illustrates a schematic of a side view of a floating dock in accordance with certain embodiments of the invention.

FIG. 2A illustrates a schematic of a side view of a floating dock 10 in accordance with certain embodiments of the invention. As noted above, the water ski ramp may comprise a floating dock 10 including a first dock portion 20 and a second dock portion 30 operatively connected to the first dock portion, in which the first dock portion and the second dock portion define an obtuse angle 'α' therebetween. The first dock portion 20 may comprise a first back end 26 and a first front end 21, while the second dock portion 30 comprises a second back end 31 and a second front end 36. As illustrated by FIG. 2A, the first back end 31 may be operatively connected to the second front end 36, such as by welding the portions together and/or via a one or more fasteners (e.g., nuts and bolts, screws, etc.). The second dock portion 30, as shown in FIG. 2A, may extend outwardly from the first back end 21 and out of an x-y plane defined by the first dock portion 20 to define an angle 'γ' between the x-y plane and the second dock portion. FIG. 2A also illustrates a dock-to-surface hinge 50, such as a corresponding pair of pivot pins located on opposite sides of the second back end 31 of the second dock portion 30. In this regard, the jumping platform 40 may include a corresponding female member or members configured to receive the pivot pin or pins of the floating dock 10. For instance, the dock-to-surface hinge 50 may comprises a pivot pin located at or proximate to the second back end 31, in which the pivot pin is configured to engage a corresponding female member of the jumping platform.

In accordance with certain embodiments of the invention, the angles 'α' and 'γ' are supplementary angles (i.e., these angles add to a sum of 180 degrees. In accordance with certain embodiments of the invention, the angle 'α' may have a value from about 2 to about 20 degrees, such as at least about any of the following: 2, 3, 4, 5, 6, 7, 8, 9, and 10 degrees, and/or at most about any of the following: 20, 19, 18, 17, 16, 15, 14, 13, 12, 11, and 10 degrees. The angle 'γ', therefore, may have any supplementary value with the angle 'α'.

Figure 2B:
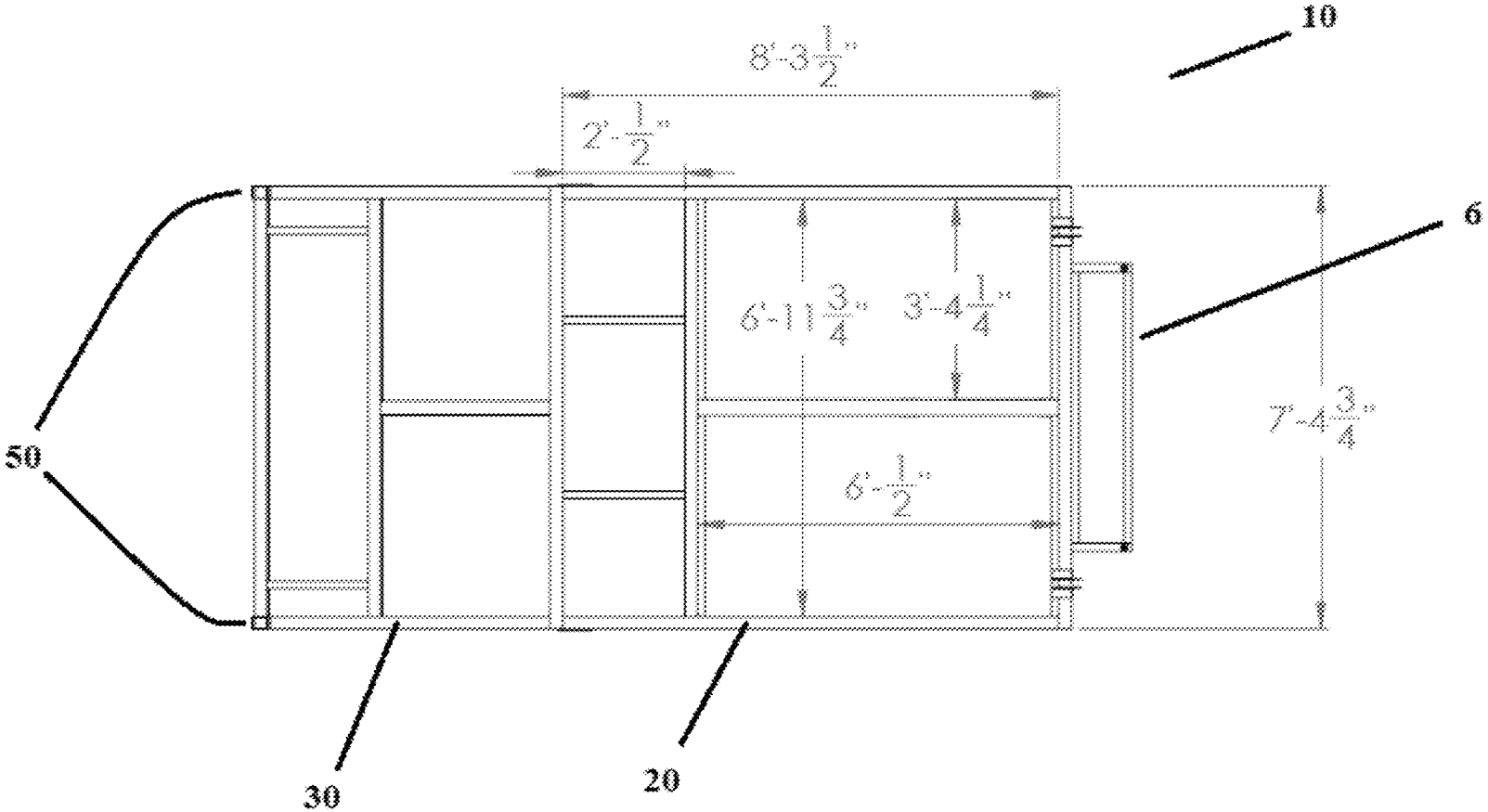
FIG. 2B illustrates a schematic of a top view of the floating dock of FIG. 2A.
Figure 2C:
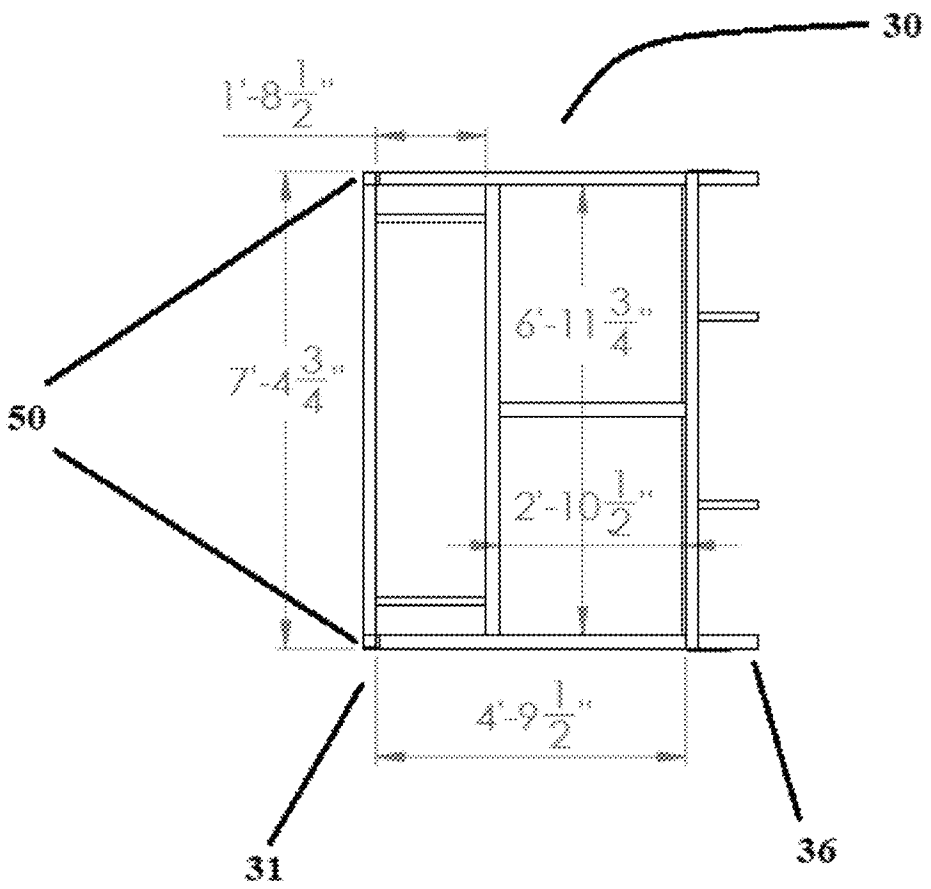
FIG. 2C illustrates a schematic of a front side of the floating dock of FIGS. 2A and 2B.

FIG. 2B illustrates a schematic of a top view of the floating dock of FIG. 2A, while FIG. 2C illustrates a schematic of a front side of the floating dock of FIGS. 2A and 23. FIGS. 2B and 2C illustrate a pair of pivot pins located at the second back end 31 of the second dock portion 30.

Figure 3A:
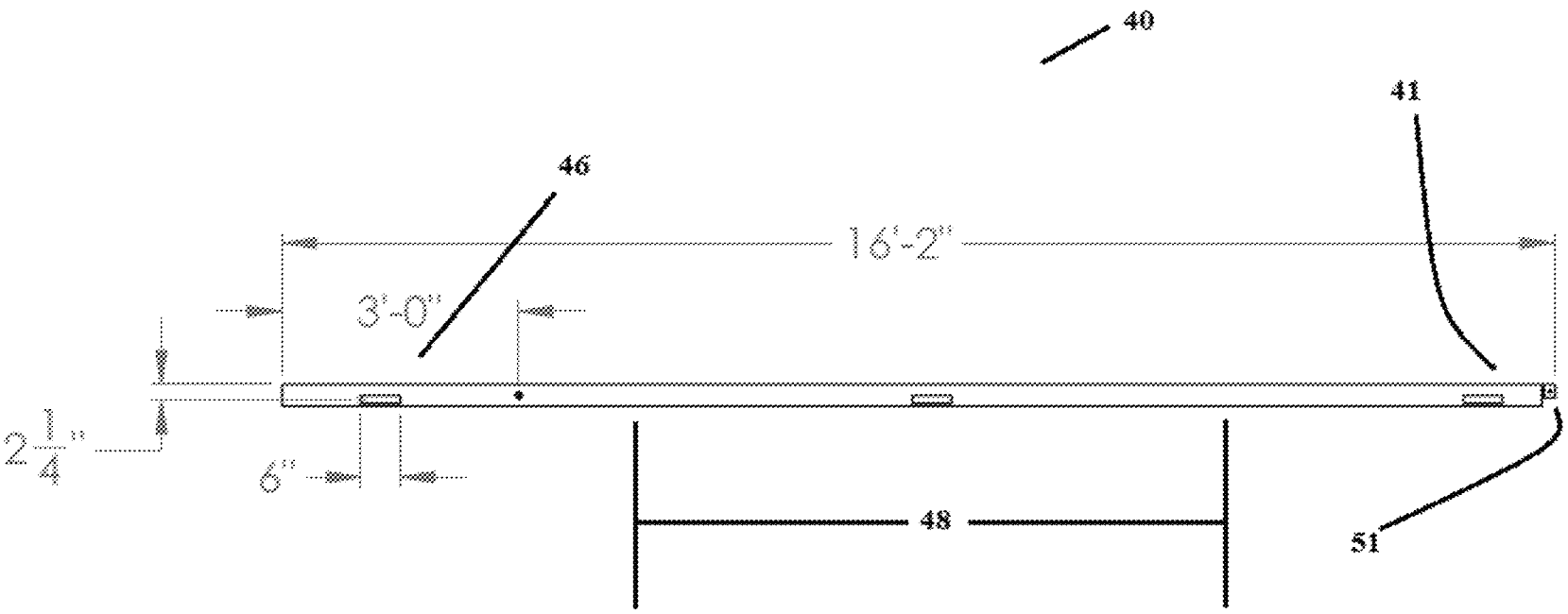
FIG. 3A illustrates a schematic of a side view of a jumping platform in accordance with certain embodiments of the invention.
Figure 3B:
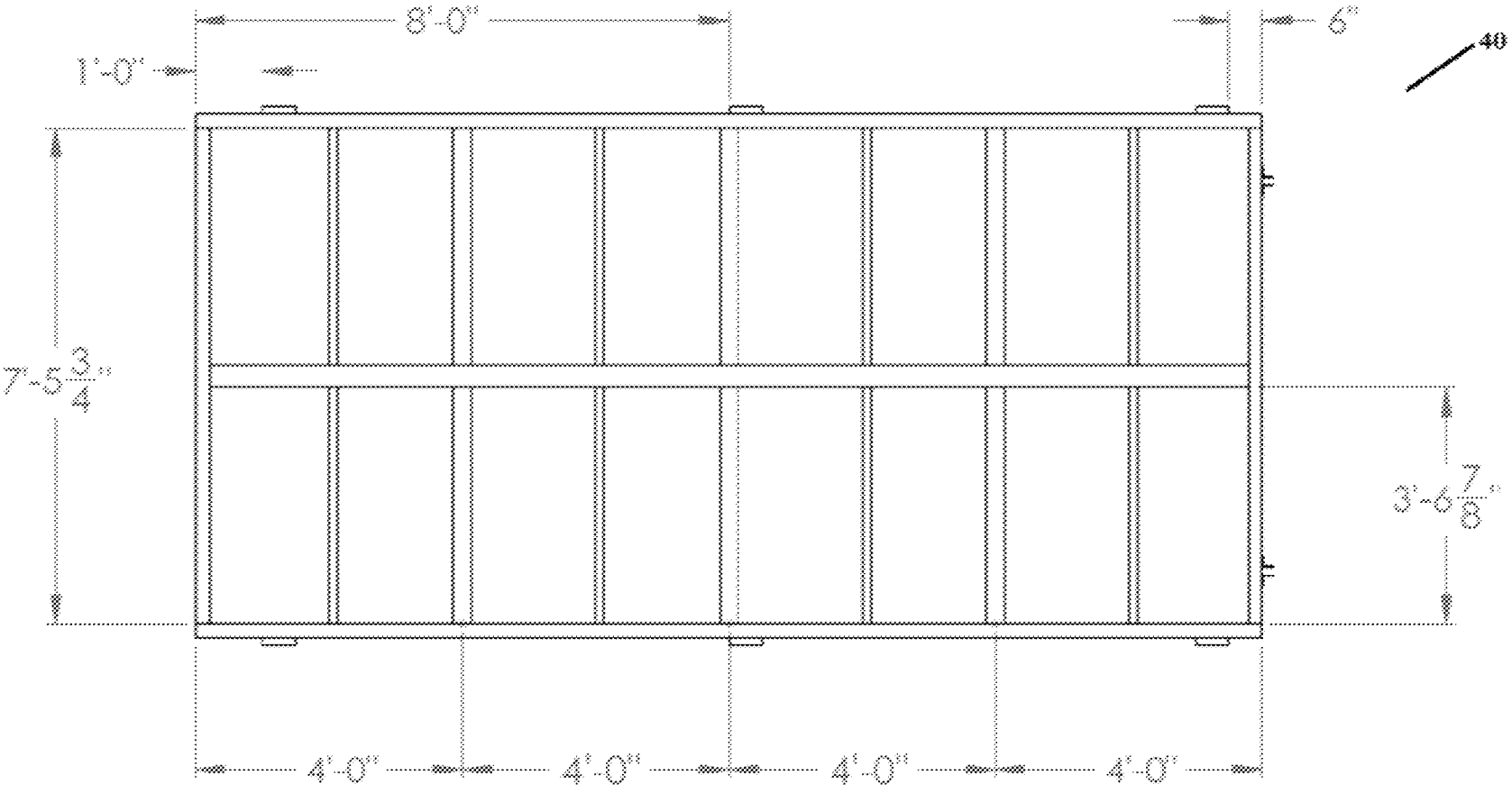
FIG. 3B illustrates a schematic of a top view of the jumping platform of FIG. 3A.
Figure 4:
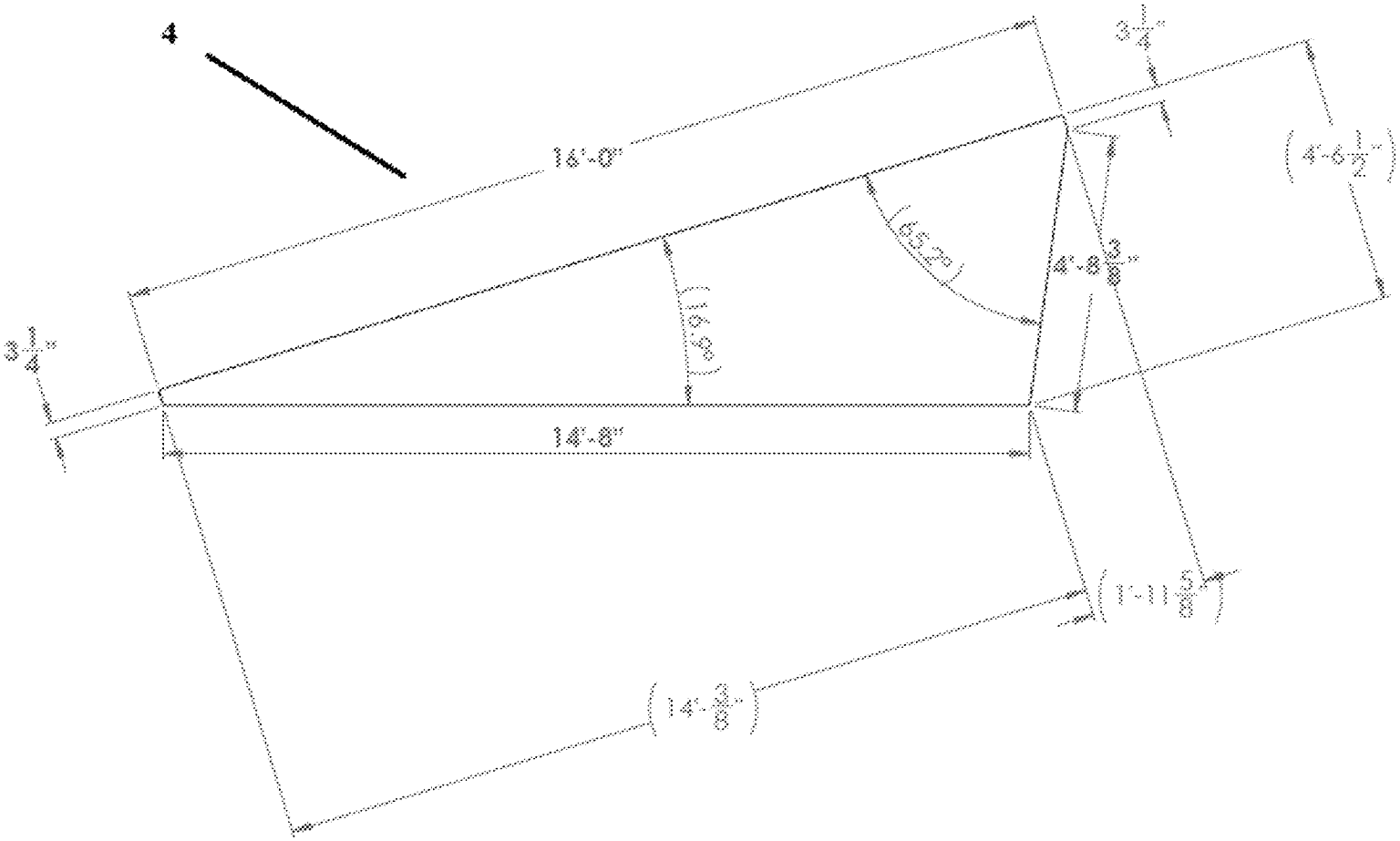
FIG. 4 illustrates a schematic of a side view of a side curtain in accordance with certain embodiments of the invention.

FIG. 3A illustrates a schematic of a side view of a jumping platform 40 in accordance with certain embodiments of the invention. FIG. 3B illustrates a schematic of a top view of the jumping platform of FIG. 3A. As shown in FIG. 3A, the jumping platform 40 comprises (when the water ski ramp is floating in a body of water) a low portion 41 located proximately to the second back end 31, and a high portion 46 located proximately to the first front end 26, in which the low portion terminates at a first location 42 below the x-y plane and the high portion terminates at a second location 47 above the x-y plane. As shown in FIGS. 3A and 313, the jumping platform 40 includes a pair of female members 51 configured to receive corresponding pivot pins 50. Upon engagement of pivot pins 50 within female members 51, the jumping platform is rotatable about an axis defined by the pivot pin(s). FIG. 3A illustrates a central body portion 48, which has been discussed above. In this regard, the central body portion 48 may comprise a plurality of discrete locations within the middle 80% of the jumping length, such as within the middle 70%, the middle 60%, the middle 50%, or the middle 40% of the jumping length. FIG. 4 illustrates a schematic of a side view of a side curtain 4 in accordance with certain embodiments of the invention. The side curtain may be directly or indirectly connected to the floating dock and/or the jumping platform.

Figure 5:
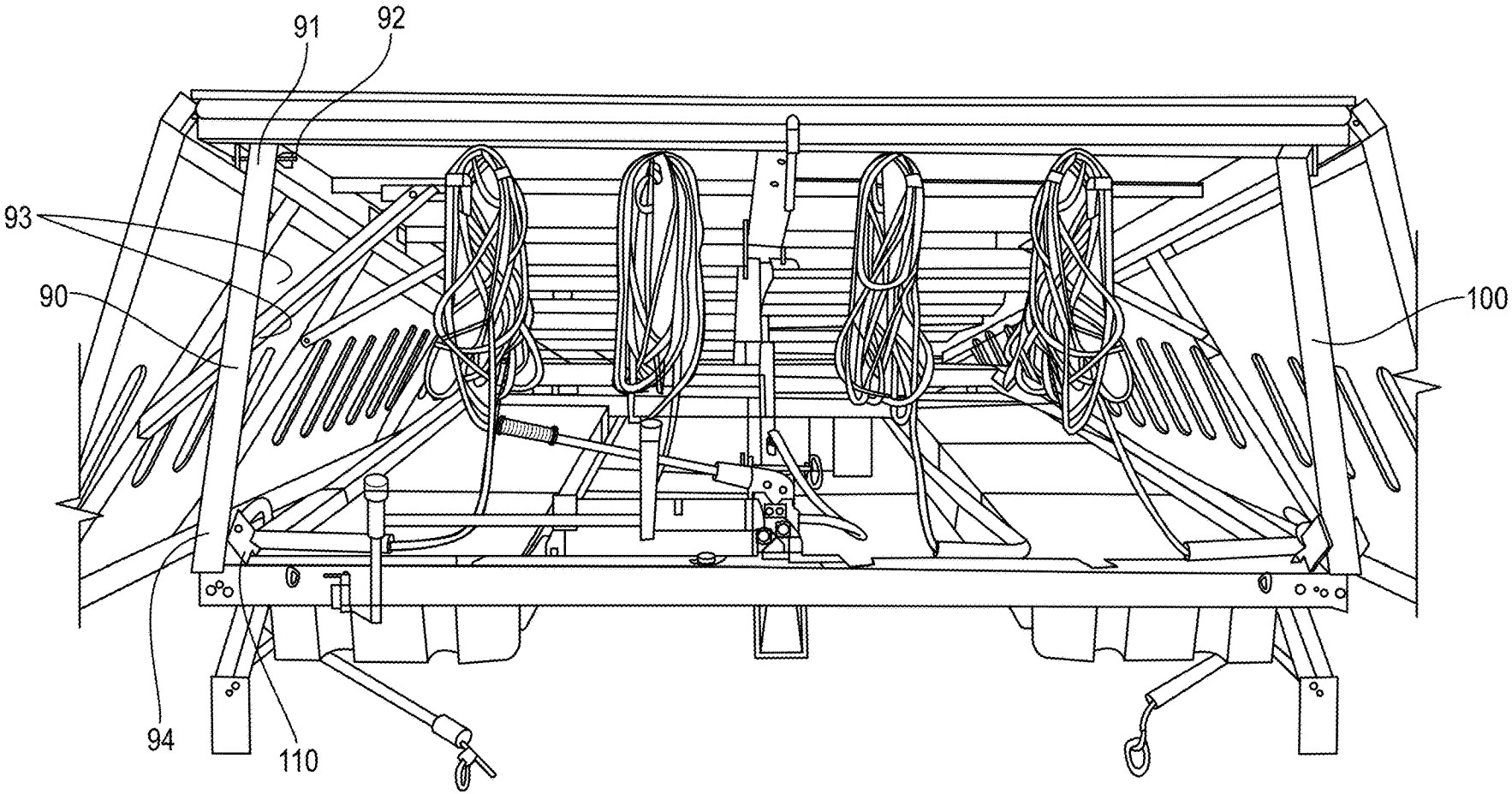
FIG. 5 illustrates an image of the front side of a water ski ramp in accordance with certain embodiments of the invention.

FIG. 5 illustrates an image of the front side of a water ski ramp in accordance with certain embodiments of the invention. As shown in FIG. 5, the water ski ramp may include at least one support column, such as a first support column 90 and a second support column 100. A first support column 90, for example, may include a first support end 91 releasably connected to the high portion of the jumping platform 40 via a first insertable and removable pin 92. The first support member 90 also includes a second support end 94 releasably connected to a the first dock portion 20 via a bracket 110 and an additional insertable and removable pin. Given that the launch height of the water ski ramp can be adjusted as noted above, the support columns can slide through the corresponding brackets to accommodate the desired launch height. Once the desired launch height is achieved, insertable and removable pins may be utilized to "lock" the support columns in place to ensure that the positioning of the jumping platform remains in a "locked" state relative to the floating dock. In this regard, the support column(s) may each include a plurality of corresponding pairs of through-holes 93 along a length of the first support column. In this regard, the plurality of corresponding pairs of through-holes may be configured or sized to receive a an insertable and removable pin.

Figure 6:
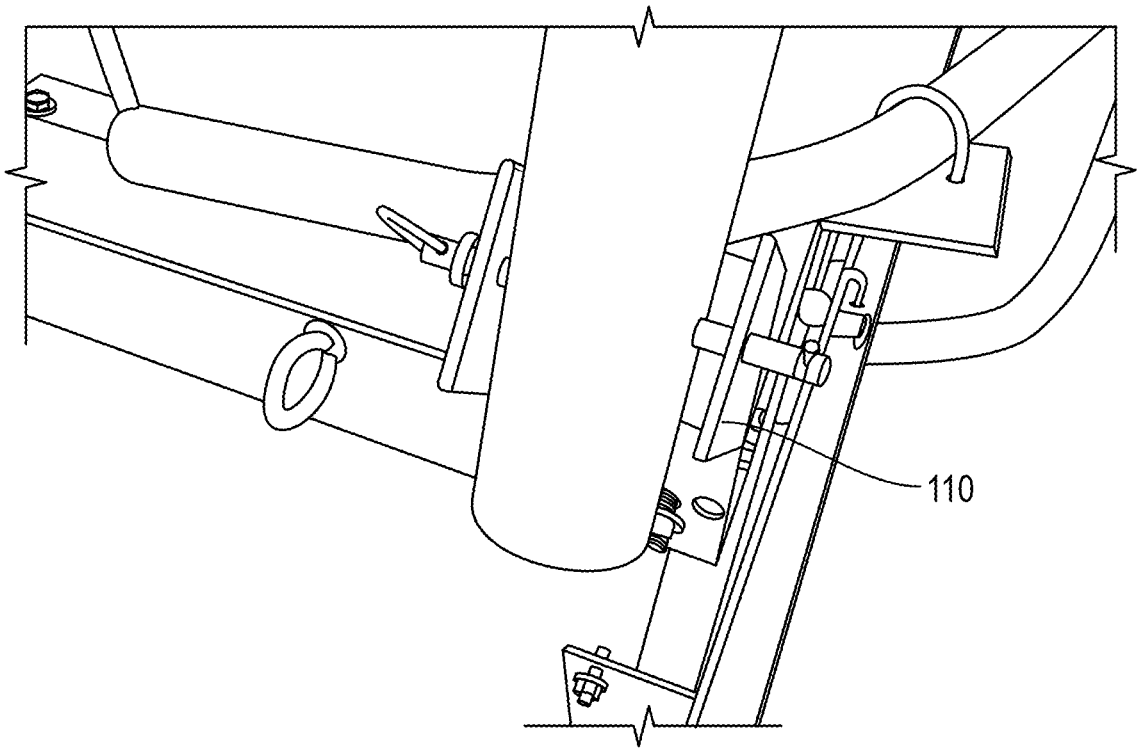
FIG. 6 illustrates an enlarged image of a retaining bracket in accordance with certain embodiments of the invention.

FIG. 6 illustrates an enlarged image of a retaining bracket 110 in accordance with certain embodiments of the invention. For instance, the first front end 26 of the first dock portion 20 may comprise at least one retaining bracket 110 including a pair of corresponding bracket-through-holes. As noted above, the support members pass through corresponding retaining brackets and respective pins pass through the pair of corresponding bracket-through-holes and a first corresponding pairs of through-holes of the respective support members to lock the support members and the jumping platform into place.

Figure 7:
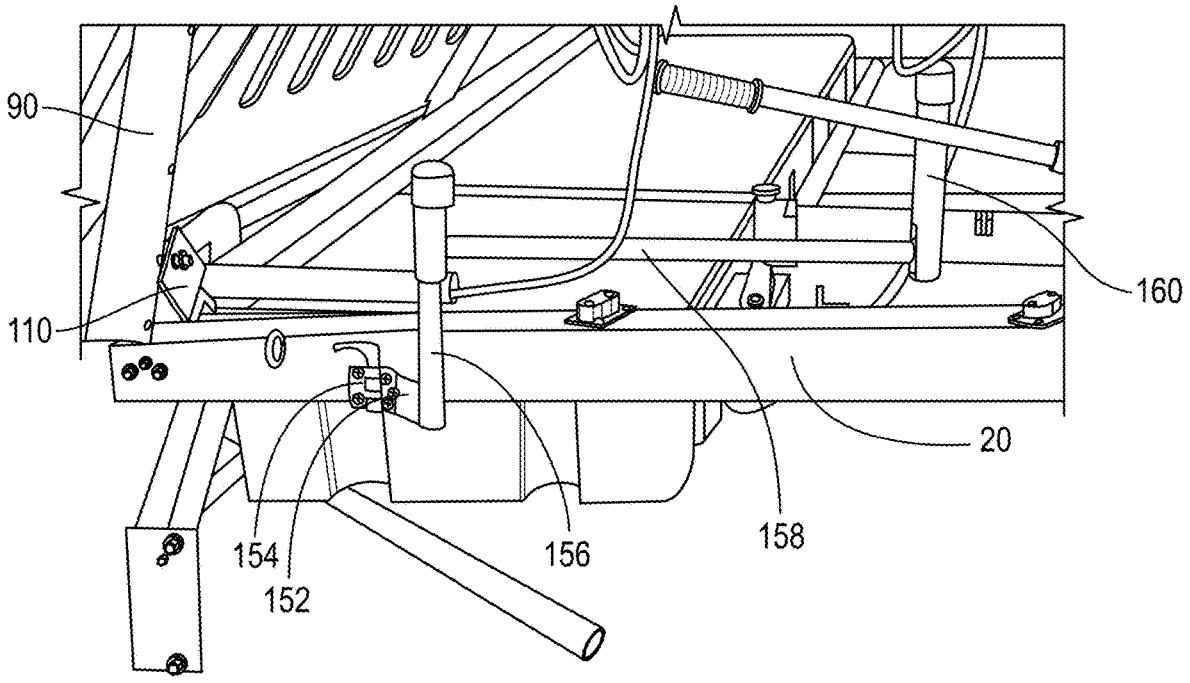
FIG. 7 illustrates an image of an extendable bumper apparatus in accordance with certain embodiments of the invention.

FIG. 7 illustrates an image of an extendable bumper apparatus in accordance with certain embodiments of the invention. As shown in FIG. 7, the extendable bumper apparatus may be operatively connected to the first dock portion 20 of the floating dock 10. The extendable bumper apparatus may comprise a first arm 152 pivotally connected to the first dock portion 20 via a first selectively adjustable hinge connection 154, a first upwardly extending member 156 connected to the first arm, a second arm 158 connected to the first upwardly extending member, and a first upwardly extending bumper 160 connected to the second arm. In this regard, the extendable bumper apparatus may be provided in a first configuration, such as a collapsed state. In the first configuration, for example, the first upwardly extending bumper 160 may be located adjacent, above, or proximate to the first dock portion 20. The extendable bumper apparatus may also adjusted to be provided in a second configuration, such as an extended state. In the second configuration, for example, the first upwardly extending bumper 160 may be located at a distal position such that an incoming boat would first contact the bumper before making contact with the kneeling platform (if present) and/or the floating dock. In accordance with certain embodiments of the invention, the first upwardly extending member 156, the first upwardly extending bumper 160, or both extend generally perpendicular to the first dock portion.

Figure 8:
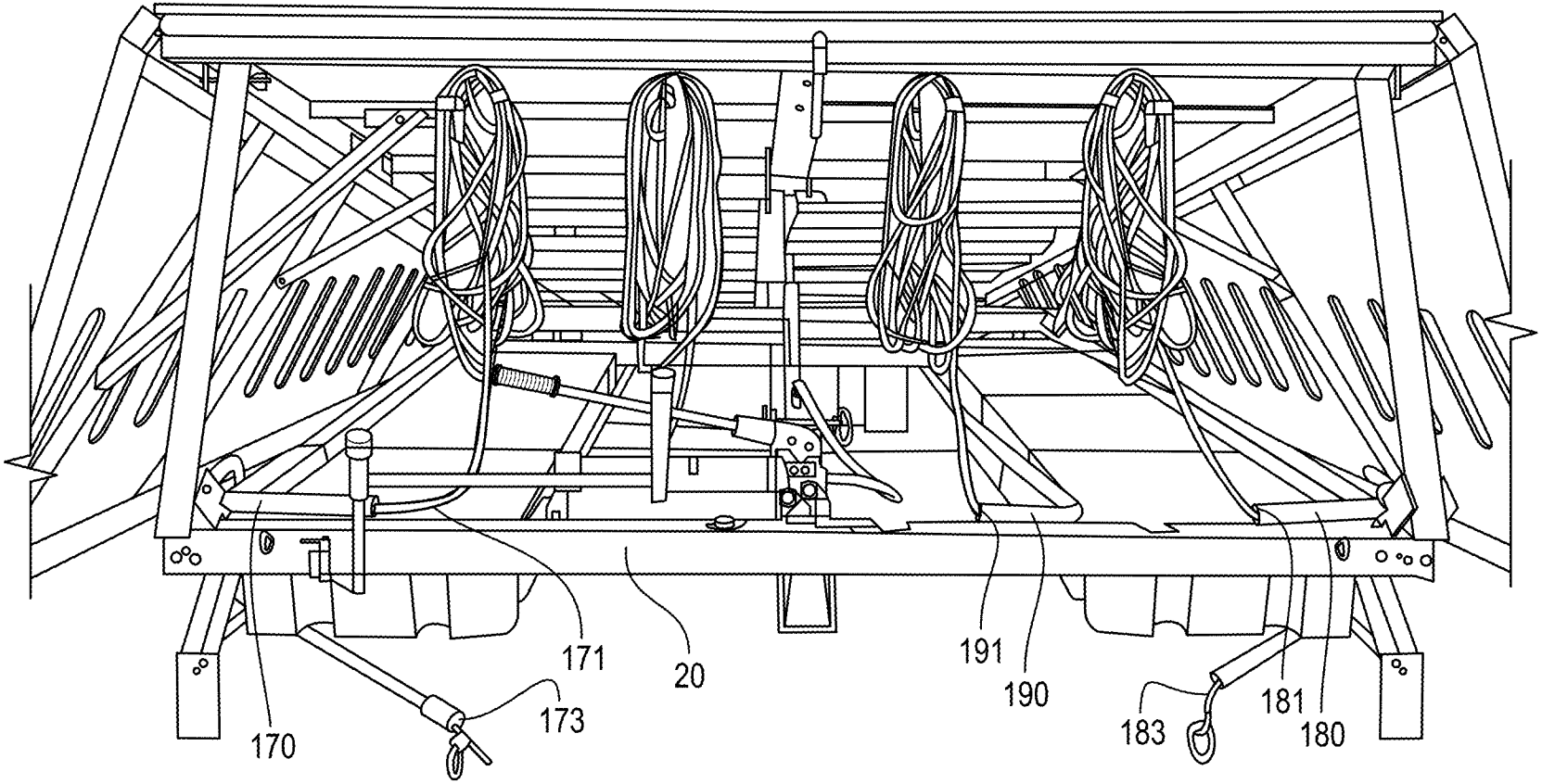
FIG. 8 illustrates an image of the front side of a water ski ramp with an emphasis on the conduits (e.g., anchoring conduits) in accordance with certain embodiments of the invention.
Figure 9:
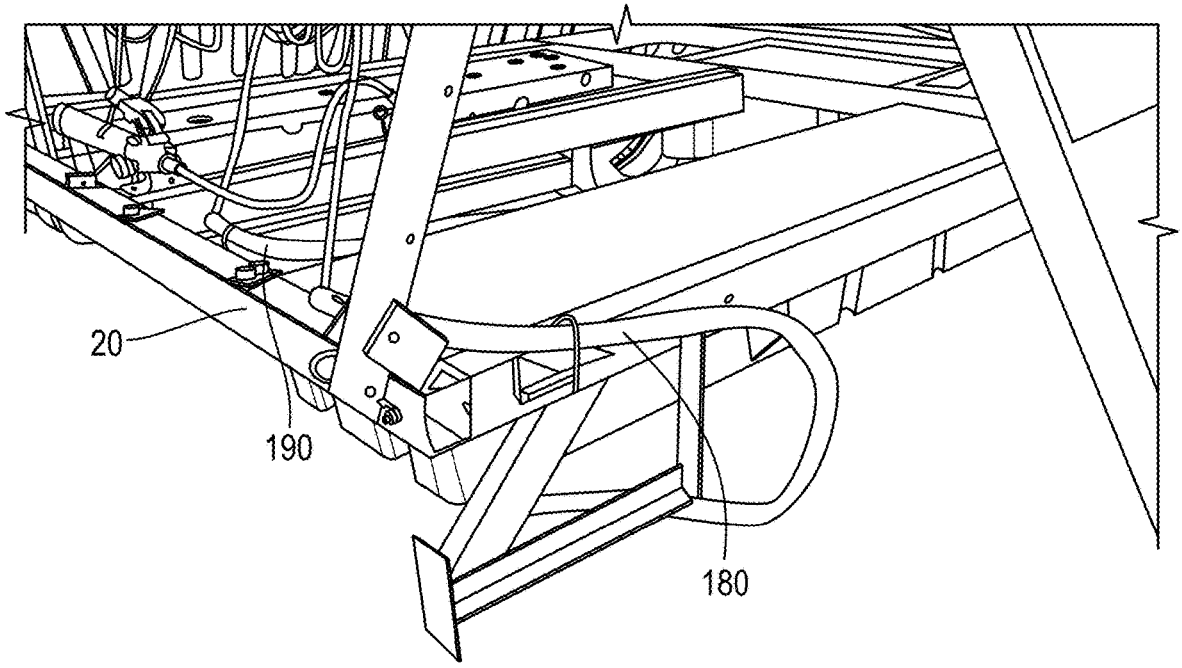
FIG. 9 illustrates an enlarged image of a conduit (e.g., an anchoring conduit) in accordance with certain embodiments of the invention.

FIG. 8 illustrates an image of the front side of a water ski ramp with an emphasis on the conduits (e.g., anchoring conduits) in accordance with certain embodiments of the invention, while FIG. 9 illustrates an enlarged image of a conduit (e.g., an anchoring conduit) in accordance with certain embodiments of the invention. As shown in FIG. 8, the water ski ramp may comprise a plurality of conduits 170, 180, 19 directly or indirectly connected to the first dock portion 20. For example, the plurality of conduits may include a first conduit 170 including a first conduit inlet 171 located above the first dock portion 20 and at or proximate to the first front end of the first dock portion and a first conduit outlet 73 located below the first dock portion and proximate the first dock portion. Additionally or alternatively, the plurality of conduits may include a second conduit 180 including a second conduit inlet 181 located above the first dock portion 20 and at or proximate to the first front end of the first dock portion and a second conduit outlet 183 located below the first dock portion and proximate the first dock portion, in which the first conduit is located at or proximate to a first side portion of the water ski jump and the second conduit is located at or proximate to a second side portion of the water ski jump. Additionally or alternatively, the plurality of conduits may include a third conduit 190 including a third conduit inlet 191 located above the first dock portion 20 or proximate the x-y plane of the first dock portion and a third conduit outlet (not shown) located below the second dock portion 30 and proximate the second dock portion. Additionally or alternatively, the plurality of conduits may include a fourth conduit (not shown) including a fourth conduit inlet located above the first dock portion or proximate the x-y plane of the first dock portion and a fourth conduit outlet located below the second dock portion and proximate the second dock portion; wherein the third conduit is located at or proximate to a first side portion of the water ski jump and the fourth conduit is located at or proximate to a second side portion of the water ski jump.

As shown in FIG. 8, the water ski ramp may comprise a plurality of anchor lines attached to the water ski ramp on respective first ends and extending through the respective conduits, in which the respective anchor lines may each include an anchor on respective second ends of the anchor lines. For example, the water ski jump may comprise a first anchor line that extends completely through the first conduit to provide a first anchoring location for the water ski ramp. The water ski ramp may comprise a second anchor line that extends completely through the second conduit to provide a second anchoring location for the water ski ramp. The water ski ramp may comprise a third anchor line that extends completely through the third conduit to provide a third anchoring location for the water ski ramp. The water ski ramp may comprise a fourth anchor line that extends completely through the second conduit to provide a fourth anchoring location for the water ski ramp.

These and other modifications and variations to embodiments of the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A water ski ramp, comprising:

(i) a floating dock comprising a first dock portion and a second dock portion operatively connected to the first dock portion, wherein the first dock portion and the second dock portion define an obtuse angle α therebetween;

(ii) a jumping platform operatively connected to the second dock portion via a dock-to-surface hinge; and (iii) an adjustable lift including a first end operatively connected to the first dock portion and a second end operatively connected to the jumping platform; wherein the adjustable lift and the first dock portion define an acute angle β therebetween.

2. The water ski ramp of claim 1, wherein the first dock portion comprises a first back end and a first front end, and the second dock portion comprises a second back end and a second front end, the first back end being operatively connected to the second front end.

3. The water ski ramp of claim 2, wherein the first dock portion comprises an outer frame substantially lying in an x-y plane.

4. The water ski ramp of claim 3, wherein the second dock portion extends outwardly from the first back end and out of the x-y plane to define an angle γ between the x-y plane and the second dock portion, in which the angle α and the angle γ are supplementary angles.

5. The water ski ramp of claim 4, wherein the dock-to-surface hinge comprises a pivot pin located at or proximate to the second back end, wherein the pivot pin is configured to engage a corresponding female member of the jumping platform.

6. The water ski ramp of claim 5, wherein the jumping platform comprises a first portion located proximately to the second back end, and a second portion located proximately to the first front end; wherein the first portion terminates at a first location below the x-y plane and the second portion terminates at a second location above the x-y plane.

7. The water ski ramp of claim 6, wherein the first portion of the jumping platform comprises the female member.

8. The water ski ramp of claim 7, wherein the jumping platform is rotatable about an axis defined by the pivot pin.

9. The water ski ramp of claim 6, wherein the first end of the adjustable lift is operatively connected to the second portion of the jumping platform or a central body portion of the jumping platform.

10. The water ski ramp of claim 6, wherein the first end of the adjustable lift is operatively connected to the jumping platform via a first pivoting connection, the second end of the adjustable lift is operatively connected to the first dock portion via a second pivoting connection, or both.

11. The water ski ramp of claim 10, wherein the adjustable lift comprises a hydraulic lift comprising a moveable cylinder to effectuate movement of the jumping platform relative to the floating dock.

12. The water ski ramp of claim 6, wherein the second location above the x-y plane of the jumping platform comprises from about 10 inches to about 60 inches above a water-air interface when the water ski ramp is located in a body of water.

13. The water ski ramp of claim 1, further comprising at least one support column releasably connecting the first dock portion and the second portion of the jumping platform.

14. The water ski ramp of claim 13, wherein the at least one support column comprises a plurality of support columns, and includes a first support column and a second support column.

15. The water ski ramp of claim 14, wherein at least the first support column includes a first support end releasably connected to the second portion of the jumping platform via a first insertable and removable pin.

16. The water ski ramp of claim 14, wherein at least the first support column includes a plurality of corresponding pairs of through-holes along a length of the first support column.

17. The water ski ramp of claim 16, wherein the plurality of corresponding pairs of through-holes are configured to receive a second insertable and removable pin.

18. The water ski ramp of claim 17, wherein the first front end of the first dock portion comprises at least one retaining bracket including a pair of corresponding bracket-through-holes; the at least one support member passes through a first retaining bracket and the second insertable and removable pin passes through the pair of corresponding bracket-through-holes and a first corresponding pairs of through-holes of the first support member to lock the first support member and the jumping platform into place.

19. The water ski ramp of claim 4, wherein the angle 'γ' comprises from about 3° to about 20°.

20. The water ski ramp of claim 19, wherein the jumping platform comprises a jump frame and a jumping surface.

* * * * *